US005316108A

United States Patent [19]

Pearson

[11] Patent Number: 5,316,108

[45] Date of Patent: May 31, 1994

[54] APPARATUS FOR ATTACHING ELEVATOR GUIDE RAILS TO ELEVATOR SHAFT WALLS

[75] Inventor: David B. Pearson, Raritan, N.J.

[73] Assignee: Inventio AG, Hergiswil, Switzerland

[21] Appl. No.: 940,639

[22] Filed: Sep. 4, 1992

[51] Int. Cl.[5] ..... B66B 7/02

[52] U.S. Cl. ..... 187/95; 238/338; 238/352

[58] Field of Search ..... 187/95, 1 R; 238/338, 238/340, 349, 351, 352

[56] References Cited

U.S. PATENT DOCUMENTS

| | | | |
|---|---|---|---|
| 1,925,867 | 9/1933 | Dunlop | 187/95 |
| 4,216,904 | 8/1980 | Vivion | 238/338 |
| 4,494,695 | 1/1985 | Sonneville | 238/338 |

FOREIGN PATENT DOCUMENTS

| | | |
|---|---|---|
| 2646762 | 4/1978 | Fed. Rep. of Germany . |
| 2367694 | 5/1978 | France . |
| 2398206 | 2/1979 | France . |
| WO90/15009 | 12/1990 | PCT Int'l Appl. . |

*Primary Examiner*—H. Grant Skaggs
*Assistant Examiner*—Kenneth Noland
*Attorney, Agent, or Firm*—William J. Clemens

[57] ABSTRACT

An apparatus for attaching a guide rail to a girder in an elevator shaft wall provides for vertical displacement of the guide rail relative to the walls of the elevator shaft. The apparatus includes a U-shaped intermediate plate of corrosion-proof metal positioned between the side surfaces of the flange of the guide rail and a U-shaped support bracket. The support bracket, the intermediate plate and the guide rail flange are held against the girder by a longer leg of a U-shaped rail clamp having a shorter leg attached to the girder. The friction coefficient between the side surfaces of the flange of the guide rail and the U-shaped intermediate plate is greater than the friction coefficient between the intermediate plate and the support bracket, so that when the guide rail is displaced vertically, the support bracket will slide on the intermediate plate.

14 Claims, 1 Drawing Sheet

APPARATUS FOR ATTACHING ELEVATOR GUIDE RAILS TO ELEVATOR SHAFT WALLS

BACKGROUND OF THE INVENTION

The invention relates to elevators generally and, in particular, to an apparatus for the attachment of guide rails to the walls of elevator shafts.

When attaching guide rails for elevators to elevator shaft walls, it must be borne in mind that in buildings, in particular new construction, contractions occur as the masonry subsides and lowers the building height. The guide rails attached to the masonry by means of girders are not subject to such contractions, so that deformations can occur between the clamped parts, which cause a rough running or operation of the elevator car and the counterweight. In the worst case, such contractions can lead to jamming or damage which make the elevator installation unserviceable. The previously described effects also can occur in high-rise buildings due to large temperatures variations, strong wind gusts and seismic forces. Precautions must be taken, therefore, which permit a longitudinal displacement between the guide rails and the masonry of the elevator shaft. For this purpose, attachment devices currently are being used which make possible a displacement of the guide rails in a longitudinal direction and prevent such displacement in a transverse or cross direction.

A device is shown in the U.S. Pat. No. 1,925,867 which is supposed to fulfill the above stated requirements. Iron rail clamps formed of spring steel are bent in a U-shape and have one shorter leg and one longer leg. The shorter leg is solidly bolted to a girder with a spacer sleeve, which girder is attached to the wall of an elevator shaft. The opposite side surfaces of the flange of the guide rail are enveloped by a U-shaped support bracket and which bracket and the flange are pressed against the girder by the longer leg of the rail clamp. The spacer sleeve protrudes through a bore hole in the longer leg such that the longer leg can move freely and apply pressure to the bracket and the guide rail. The U-shaped support brackets, which are held positively by the rail clamps in the longitudinal direction of the guide rail, reduce friction when the guide rail moves relative to the wall of the elevator shaft in a vertical direction.

The device described above has the disadvantage that due to progressive corrosion, the deteriorating surface of the guide rail becomes rough and the free sliding movement in the U-shaped support bracket is rendered difficult or is completely prevented. In order to avoid this, the solidly rusted parts have to be separated from each other and the guide rails be made smooth and lubricated, whereby the upkeep of the elevator installation is made more expensive.

In a mounting of the guide rails shown in the German patent document DE-A 26 46 762, both sides of the flange of the guide rail are enveloped by a single appropriately shaped intermediate plate. Further intermediate plates are provided on the rail clamps and on the mounting plates which are attached in the elevator shaft. The guide rails are held on the mounting plates by the rail clamps while the intermediate plates are pressed on by the sides of the flange. In order to assure a satisfactory shifting or displacement of the guide rails in a vertical direction, a material which exhibits low adhesive and friction coefficients, such as for example Teflon material, is proposed for at least one of the intermediate plates. This solution is expensive with regard to the material and design. Furthermore, Teflon material exhibits creep, so that the intermediate plates deform and have to be replaced frequently, which again raises the maintenance cost of the installation.

SUMMARY OF THE INVENTION

The present invention solves the above described problems by providing a device which is simple and of low cost and for which the condition of the surface of the guide rails during a displacement in relation to the masonry of the elevator shaft is no longer of any importance. A U-shaped intermediate plate of corrosion resistant metal is provided between the sides of the flange of the guide rail and the U-shaped support bracket. The coefficient of friction between the sides of the flange of the guide rail and the U-shaped intermediate plate is greater than the coefficient of friction between the U-shaped intermediate plate and the U-shaped support bracket, so that the support bracket slides on the intermediate plate during the displacement of the guide rail. intermediate plates provided at the attachment points of the guide rails can be manufactured simply and at low cost and can be installed without difficulty so that this part of the elevator installation can be constructed at a lower cost. Since the intermediate plates are made of stainless steel, they do not have to be replaced so that no maintenance costs are incurred relating to them.

The present invention concerns an apparatus for attaching a guide rail for an elevator car to a girder which is mounted on a wall of an elevator shaft. The guide rail has a vertically extending flange with opposed side surfaces. The apparatus includes a U-shaped support bracket enveloping the side surfaces of the flange, a U-shaped rail clamp having a shorter leg attached to a flange of a girder and having a longer leg and a U-shaped intermediate plate positioned between the side surfaces of the flange and the legs of the support bracket. The intermediate plate is formed of a first predetermined material and the support bracket is formed of a second predetermined material wherein a friction coefficient between the side surfaces of the flange of the guide rail and the intermediate plate is greater than a friction coefficient between the intermediate plate and the support bracket. The first predetermined material can be a stainless steel material and the second predetermined material can be a brass material. The shorter leg and the longer leg each have an aperture formed therein and a bolt and a spacer sleeve, said bolt extending through said apertures and said spacer sleeve for attaching said rail clamp to the girder, said spacer sleeve extending through said aperture formed in said longer leg between said shorter leg and a head of said bolt.

BRIEF DESCRIPTION OF THE DRAWINGS

The above, as well as other advantages of the present invention, will become readily apparent to those skilled in the art from the following detailed description of a preferred embodiment when considered in the light of the accompanying drawings in which.

DESCRIPTION OF THE PREFERRED EMBODIMENT

Figure 1:
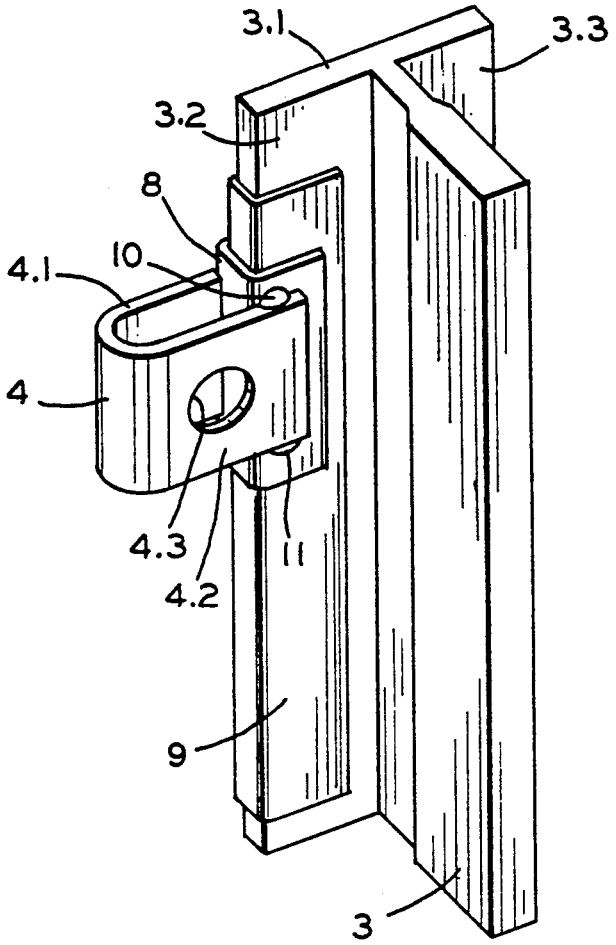
FIG. 1 is a perspective view of a section of elevator guide rail incorporating an apparatus for attachment to an elevator shaft wall according to the present invention.
Figure 2:
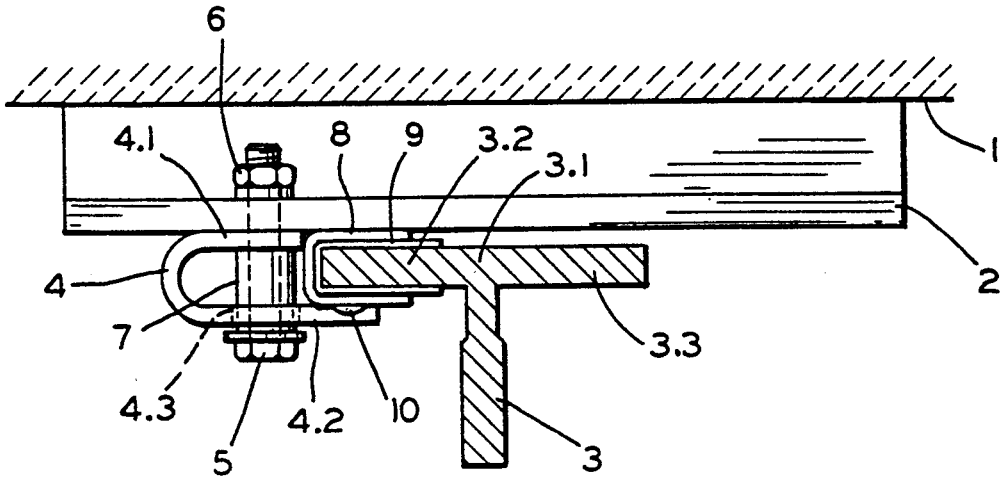
FIG. 2 is a top plan view in cross section of the guide rail and the apparatus for attachment shown in the FIG. 1 mounted on a girder in an elevator shaft.

In the FIG. 2 there is shown a portion of a wall 1 of an elevator shaft upon which is mounted a girder 2. A vertically extending guide rail 3 is attached to the girder 2 by means of an apparatus for attachment according to the present invention including a rail clamp 4. The rail clamp 4 is preferably formed of a spring steel material and, as shown in the FIGS. 1 and 2, is bent in a U-shape having a shorter leg 4.1 and a longer leg 4.2. The shorter leg 4.1 is attached to the girder 2 by a bolt 5 and a nut 6 at a generally vertically extending flange portion spaced from the wall 1. The bolt 5 extends from a head end through a flat washer, through an aperture 4.3 formed in the longer leg 4.2, through a tubular spacer sleeve 7, through an aperture formed in the shorter leg 4.1, through an aperture formed in the flange of the girder 2 and through a lock washer and is threadably engaged at a free end by the nut 6. The spacer sleeve 7 abuts the shorter leg 4.1 at one end and has an opposite end which extends through the aperture 4.3 and protrudes beyond the longer leg 4.2 to abut the flat washer. Thus, the longer leg 4.2 can move freely and the length of the shorter leg 4.1 is such that, as described below, the guide rail 3 cannot shift its position transverse to its longitudinal axis.

A flange 3.1 of the guide rail 3 has a pair of oppositely extending arms 3.2 and 3.3. The first arm 3.2 is enveloped by a U-shaped support bracket 8 which, for example, can be made of a suitable material such as brass. Provided between the side surfaces of the arm 3.2 and the U-shaped support bracket 8 is a U-shaped intermediate plate 9 formed of a suitable material such as a corrosion-proof metal, preferably stainless steel. When the bolt 5 and the nut 6 are tightened, the longer leg 4.2 of the rail clamp 4 exerts a force pressing the support bracket 8, the intermediate plate 9 and the first arm 3.2 of the flange 3.1 against the girder 2. As stated above, the spacer sleeve 7 protrudes through the aperture 4.3 formed in the longer leg 4.2, beyond the same, so that the longer leg 4.2 can move freely and only an adjusted pretension or initial force of the rail clamp 4 has an effect for the mounting support of the guide rail 3. When utilizing guide rails 3 which are not corrosion-proof and have a rough surface, the friction coefficient between the side surfaces of the first arm 3.2 of the flange 3.1 of the guide rail 3 and the U-shaped intermediate plate 9 is greater than the friction coefficient between the U-shaped intermediate plate 9 and the U-shaped support bracket 8, so that as the guide rail 3 is displaced vertically, the support bracket 8 slides on the intermediate plate 9.

The position of the support bracket 8 is fixed in a vertical direction by two lugs 10 and 11 formed on an outwardly facing surface of the support bracket 8, which lugs lie adjacent to the transversely extending side edges of the longer leg 4.2 of the rail clamp 4. The U-shaped intermediate plate 9 is wider and longer than the U-shaped support bracket 8 to provide a sliding surface. Because the sliding movement of the guide rails 3 in a case of settling of high buildings can be as much as about seventy-five millimeters, the length of the intermediate plate 9 is a multiple of the length of the support bracket 8. Considering the length of the support bracket 8, a length of the intermediate plate 9 of about three hundred millimeters has proven to be advantageous.

Although only the one apparatus for attachment has been shown and described, the guide rails are formed in sections each of which extends for a considerable vertical distance in an elevator shaft. Thus, the rail clamp 4, the support bracket 8 and the intermediate plate 9 are duplicated at spaced intervals on both the first arm 3.2 and the second arm 3.3 of the flange 3.1. The free end of the shorter arm 4.1 abuts the support bracket 8 to prevent transverse movement of the guide rail 3 even though the longer arm 4.2 is free to move in any direction limited only by contact between the sleeve 7 and the periphery of the aperture 4.3.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. In an apparatus for attaching guide rails for elevators to girders which are mounted on walls of an elevator shaft, wherein opposed side surfaces of a flange of the guide rails are enveloped by a U-shaped support bracket and are pressed together with the bracket by a rail clamp onto the girder, the improvement comprising: a generally U-shaped intermediate plate formed of a first predetermined material positioned between the side surfaces of the flange of the guide rail and the U-shaped support bracket, the U-shaped support bracket being formed of a second predetermined material wherein a friction coefficient between the side surfaces of the flange of the guide rail and said U-shaped intermediate plate is greater than a friction coefficient between said U-shaped intermediate plate and the U-shaped support bracket.

2. The apparatus according to claim 1 wherein said U-shaped intermediate plate is formed of a stainless steel material.

3. The apparatus according to claim 1 wherein the U-shaped support bracket is formed of a brass material.

4. The apparatus according to claim 1 wherein said first predetermined material is a stainless steel material and said second predetermined material is a brass material.

5. An apparatus for attaching guide rails for elevators to girders which are mounted on walls of an elevator shaft, the guide rails having opposed side surfaces of a flange, comprising:

a U-shaped support bracket enveloping opposed side surfaces of a flange of a guide rail;

a U-shaped rail clamp having a shorter leg attached to a flange of an elevator shaft girder and having a longer leg abutting said support bracket; and a U-shaped intermediate plate positioned between the side surfaces of the flange of the guide rail and said legs of said U-shaped support bracket, said intermediate plate being formed of a first material and said support bracket being formed of a second material wherein a friction coefficient between the side surfaces of the flange of the guide rail and said U-shaped intermediate plate is greater than a friction coefficient between said U-shaped intermediate plate and said U-shaped support bracket.

6. The apparatus according to claim 5 wherein said first predetermined material is a stainless steel material.

7. The apparatus according to claim 5 wherein said second predetermined material is a brass material.

8. The apparatus according to claim 5 wherein said shorter leg and said longer leg each have an aperture formed therein and including a bolt extending through said apertures for attaching said rail clamp to the girder.

9. The apparatus according to claim 8 including a generally tubular spacer sleeve for receiving said bolt, said sleeve extending through said aperture formed in said longer leg between said shorter leg and a head of said bolt.

10. An apparatus for attaching guide rails for elevators to girders which are mounted on walls of an elevator shaft comprising:

a guide rail having a flange with opposed side surfaces;

a U-shaped support bracket enveloping said side surfaces of said flange;

a U-shaped rail clamp having a shorter leg for attachment to a flange of a girder and having a longer leg; and a U-shaped intermediate plate positioned between said side surfaces of said flange and said legs of said U-shaped support bracket, said intermediate plate being formed of a first predetermined material and said support bracket being formed of a second predetermined material wherein a friction coefficient between said side surfaces of said flange of said guide rail and said U-shaped intermediate plate is greater than a friction coefficient between said U-shaped intermediate plate and said U-shaped support bracket.

11. The apparatus according to claim 10 wherein said first predetermined material is a stainless steel material.

12. The apparatus according to claim 10 wherein said second predetermined material is a brass material.

13. The apparatus according to claim 10 wherein said shorter leg and said longer leg each have an aperture formed therein and including a bolt and a spacer sleeve, said bolt extending through said apertures and said spacer sleeve for attaching said rail clamp to the girder, said spacer sleeve extending through said aperture formed in said longer leg between said shorter leg and a head of said bolt.

14. The apparatus according to claim 10 including a pair of vertically spaced apart lugs formed on said support bracket and engaging opposed side edges of said longer leg.

* * * * *